US006371458B1

(12) United States Patent
Stjerna

(10) Patent No.: US 6,371,458 B1
(45) Date of Patent: Apr. 16, 2002

(54) SPRING MATTRESS

(75) Inventor: NilsEric Stjerna, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 0 days.

(21) Appl. No.: 09/424,788

(22) PCT Filed: May 8, 1998

(86) PCT No.: PCT/SE98/00844

§ 371 Date: Nov. 30, 1999

§ 102(e) Date: Nov. 30, 1999

(87) PCT Pub. No.: WO98/53724

PCT Pub. Date: Dec. 3, 1998

(30) Foreign Application Priority Data

May 30, 1997 (SE) ..... 9702045

(51) Int. Cl.[7] ..... A47C 23/32; A47C 23/053; A47C 23/055; B68G 7/00

(52) U.S. Cl. ..... 267/91; 5/252; 29/91; 29/91.1

(58) Field of Search ..... 267/80, 81, 83, 267/85, 86, 87, 88, 89, 90, 91, 92, 93, 95, 100–112, 286, 166, 287, 169; 5/248, 256, 657, 252, 259.1, 257, 253, 282.1, 720; 29/91.1, 91

(56) References Cited

U.S. PATENT DOCUMENTS

| | | | | |
|---|---|---|---|---|
| 882,600 | A | * | 3/1908 | Weborg |
| 1,111,076 | A | * | 9/1914 | Lewis |
| 1,150,754 | A | * | 8/1915 | Franz |
| 1,155,392 | A | * | 10/1915 | Young |
| 1,248,956 | A | * | 12/1917 | Vincent |
| 1,261,655 | A | | 4/1918 | Vallone |
| 1,418,469 | A | | 6/1922 | Reidenbach |
| 2,054,868 | A | * | 9/1936 | Schwartzman |
| 2,129,251 | A | * | 9/1938 | Venzke |
| 2,184,517 | A | * | 12/1939 | Duvall et al. |
| 2,348,897 | A | * | 5/1944 | Gladstone |
| 2,657,740 | A | * | 11/1953 | Daniels et al. |
| 2,724,842 | A | * | 11/1955 | Rogovy |
| 3,009,171 | A | * | 11/1961 | Rymland |
| 3,198,508 | A | * | 8/1965 | Melton et al. |
| 3,206,759 | A | * | 9/1965 | Kline |
| 3,608,107 | A | * | 9/1971 | Kentor et al. |
| 3,674,250 | A | * | 7/1972 | Joseph |
| 3,866,896 | A | * | 2/1975 | Wehner |
| 4,895,352 | A | * | 1/1990 | Stumpf |
| 5,063,625 | A | * | 11/1991 | Perry ..... 267/89 |
| 5,149,064 | A | * | 9/1992 | Schulz, Jr. ..... 267/88 |
| 5,363,522 | A | * | 11/1994 | McGraw |
| 5,927,696 | A | * | 7/1999 | Hagemeister |
| 6,049,959 | A | * | 4/2000 | Grondahl ..... 267/91.1 |
| 6,175,997 | B1 | * | 1/2001 | Mossbeck ..... 267/91 |
| 6,186,483 | B1 | * | 2/2001 | Bullard |
| 6,260,223 | B1 | * | 7/2001 | Mossbeck et al. |

FOREIGN PATENT DOCUMENTS

| | | | |
|---|---|---|---|
| DE | 477710 | | 6/1929 |
| GB | 430564 | | 6/1935 |
| NO | 5636 | | 2/1897 |
| NO | 8325 | | 10/1899 |
| NO | 59281 | | 4/1938 |
| WO | 9934711 | * | 2/1999 |
| WO | 9935081 | * | 7/1999 |

* cited by examiner

*Primary Examiner*—Douglas C. Butler
(74) *Attorney, Agent, or Firm*—Birch, Stewart, Kolasch & Birch, LLP

(57) ABSTRACT

The invention relates to a spring mattress comprising a plurality of interconnected coil spring elements, whereby the mattress includes at least two layers extending in parallel with the plane on the mattress and each exhibiting different properties of resilience. The feature characterizing the mattress in accordance with the invention are that the same coil springs extend across both the layers and that these coil springs exhibit a higher degree of bias only along part of their extension, thus forming the layers exhibiting different properties of resilience.

21 Claims, 2 Drawing Sheets

SPRING MATTRESS

Figure 1:
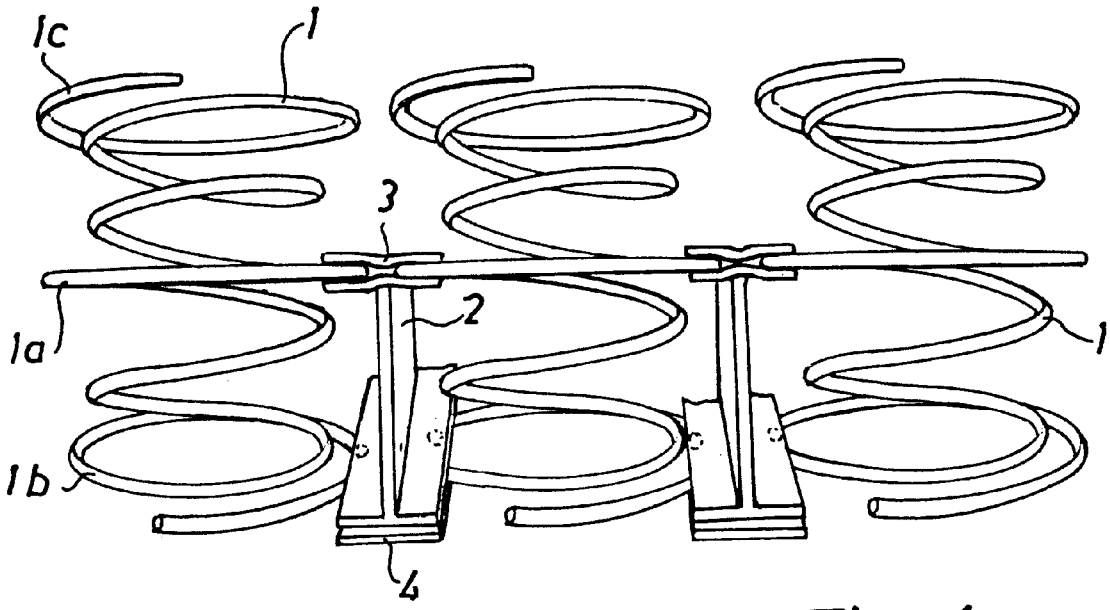

This application is the national phase under 35 U.S.C. §371 of PCT International Application No. PCT/SE98/00844 which has an International filing date of May 8, 1998 which designated the United States of America.

TECHNICAL FIELD

The present invention relates to a spring mattress comprising a plurality of interconnected coil-spring elements. The mattress having at least two layers extending in parallel with the plane of the mattress and each exhibiting a different properties of resilience.

BACKGROUND

Quality spring mattresses today normally comprise two superposed layers of coil springs disposed between the bed frame and the surface of the mattress. In some cases the springs in one of the spring layers are enclosed in an external cover, usually made from a textile material. As a result of the provision of these outer covers the springs assume a partly biased position in the normal, unloaded condition of the mattress.

However, these mattresses are comparatively complicated to manufacture, since they comprise a large number of different components. They are also relatively cumbersome to assemble, considering that each spring in the biased layer must be sewn into a separate cover, in addition to which the springs thereafter must be tied to one another in order to form a layer. The layer then must be anchored to a lower, non-biased layer and to frame parts and the like.

OBJECT OF THE INVENTION

Consequently it is an object of the subject invention to provide a spring mattress and a method of manufacturing the same, the mattress being of a kind that comprises layers exhibiting different qualities of resilience but that contains fewer components, while at the same time the mattress is more convenient and less expensive to manufacture than hitherto known mattresses of this kind.

According to a further aspect of the invention a mattress of the kind referred to is provided, which improves the user's comfort because the layer having the lesser bias is turned towards the surface of the mattress and/or because the springs occupying this layer are individually resilient.

BRIEF DESCRIPTION OF THE DRAWING FIGURES

Figure 2:
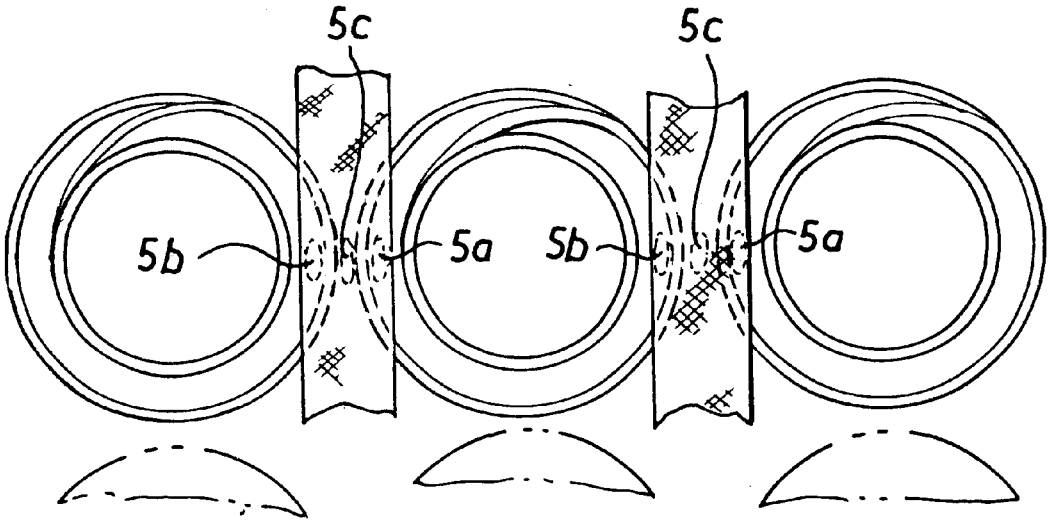

The invention will be described in more detail in the following for exemplifying purposes, reference being made to the accompanying drawings, wherein FIG. 1 is a view of a part of a spring mattress in accordance with one embodiment of the invention, as seen from the side, FIG. 2 is a view from below of the spring mattress of FIG. 1.

Figure 3:
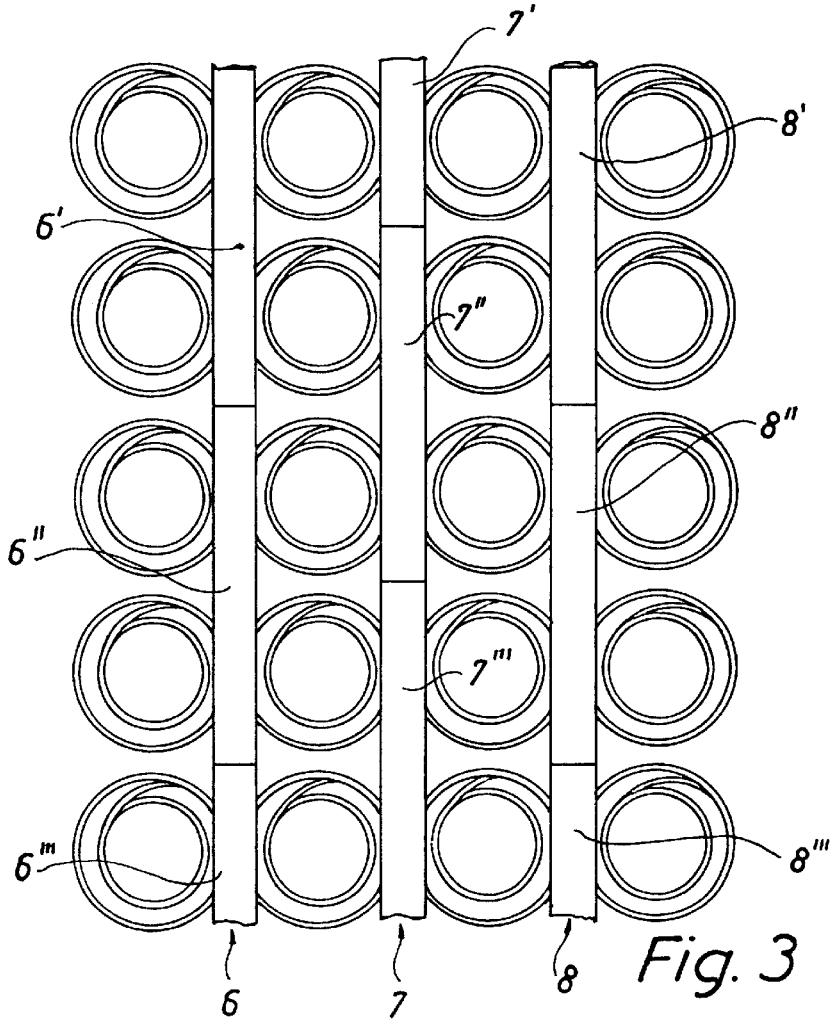
Figure 4:
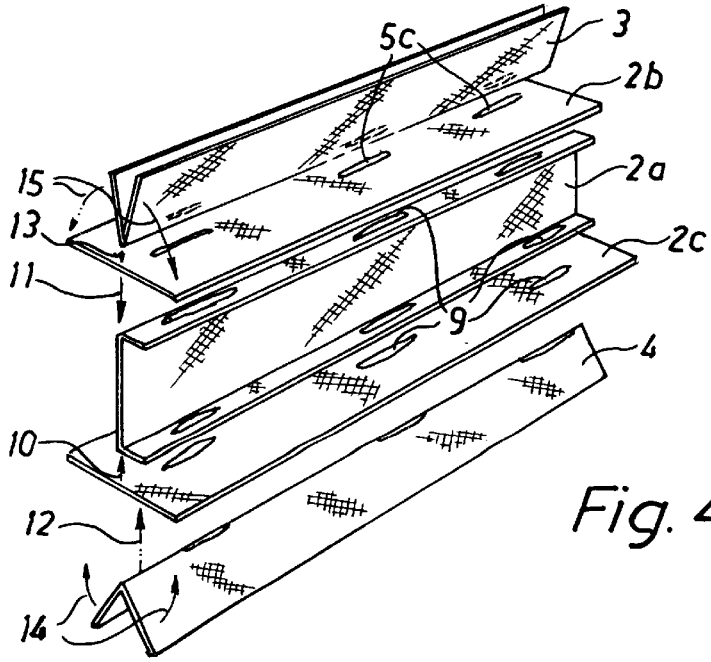

FIG. 3 is a view of a larger part of the spring mattress of FIG. 1 as seen from below, and FIG. 4 is an exploded view of the interconnecting tie strips in accordance with one embodiment of the invention.

DESCRIPTION OF PREFERRED EMBODIMENTS

FIG. 1 illustrates in a lateral view one layer of springs in accordance with the invention, and FIG. 2 illustrates the same layer of springs in a view from below. The mattress in accordance with the invention comprises only one single layer of coil springs 1, extending resiliently between the bed frame and the surface of the mattress. Parts of these springs, for instance the lower half or a central part of the springs, are biased, as will be described in more detail in the following, resulting in the formation of at least two layers exhibiting different properties of resilience but wherein the same springs extend through both layers.

The biased condition is achieved in accordance with the teachings of the invention by strip pieces 2 attached in such a manner as to extend between two turns 1*a* and 1*b* in the springs. Preferably, strip pieces 2 having an I-shaped configuration are used, allowing the strip pieces to be anchored to two neighboring springs as shown in the appended drawing figures. Strips 3 and 4, which may be flat, are attached on the top and on the lower faces, respectively, of the I-shaped strip pieces by means of spot welding or the like. Preferably, one point of attachment 5*a*, 5*b* is located internally of a turn of each spring and a further point of attachment 5*c* intermediate the springs in each pair of adjoining springs.

It is likewise advantageous to arrange for the planes of extension of both turns 1*a*, 1*b* of each spring secured as indicated above to be essentially perpendicular to the longitudinal axis of the spring, in order to thus prevent the strip attachments from sliding on the spring wire. This arrangement is not, however, necessary, if the strips are anchored directly to the spring wire.

By adjusting the length of the strip pieces and the number of turns of two adjoining, interconnected springs, the biasing force of the springs is easily adapted to the desired strength.

The biasing means, consisting of the strip pieces arranged as described above, are advantageously positioned in succession along lines 6, 7, 8 extending in parallel with one another and in parallel with the plane of the mattress, as appears from FIG. 3. Each biasing means thus preferably joins together several pairs of neighboring springs, for instance two or three such pairs. In this manner, the springs of the mattress are interconnected and cooperate to absorb pressure exerted on the mattress while at the same time each spring may be compressed comparatively individually. The latter property is desirable both for reasons of comfort and for preventing displacement of the mattress sides when a load is exerted on the middle region of the mattress.

The feature of dividing the biasing elements in the manner indicted above such that each individual spring is connected only to a small number of other springs is important, especially in the part of the layer that is turned towards the top of the mattress, i.e. in the turn 1*a* of the springs of FIG. 1. At the opposite end, on the other hand, such division is uncalled for, since the springs are not to be compressed from this direction. On the contrary, it might even be desirable to refrain from such division of the biasing elements at this end, as this contributes to the integrity of the mattress and to its firmness and stability. Preferably, the flat strips 3 therefore are divided in the above-mentioned manner whereas the flat strips 4 are not. The strip pieces 2 having an I-shaped cross-section could either be completely divided or partly divided in such a manner as to be slit from the part facing the strip 3 and across part of its extension towards the strips 4.

In addition, the biasing elements could be disposed in staggered relationship in the different lines 6, 7 8 in the direction of extension of the individual lines. Thus, as shown in the illustrated embodiment, the biasing elements 6' in line 6 may be positioned in alignment with element 8' in line 8, elements 6" in alignment with elements 8" and so on, whereas elements 7' and 7" and so on, positioned in line 7 intermediate lines 6 and 8, may be displaced relative to the elements in lines 6 and 8 by a distance corresponding to one pair of springs. This staggered arrangement improves the stability and the integrity of the springs in the mattress.

In the mattress in accordance with the shown embodiment the less biased layer is turned towards the surface of the mattress whereas the higher-bias layer is positioned underneath. In the less biased layer the springs are also individually resilient. This feature provides excellent qualities of comfort, since it means that the upper layer adapts to the geometry of the user's body with resulting even distribution of the carrying force. The lower layer has a higher bias and consequently the springs in this layer will not be compressed, unless the force exceeds a predetermined threshold value which depends on the magnitude of the bias. This means that this layer will be compressed and be active in places where the user-induced depression is the highest, as is the case underneath the user's buttocks and shoulders, and consequently the user's spine will be straightened.

The biasing elements may be manufactured in the manner appearing from FIG. 4. Initially, a piece of strip 2*a* is bent into U-shape and further strip pieces 2*b* and 2*c*, respectively, are attached to the external faces of the flanges of the U-shaped element, as illustrated by arrows 10 and 11. The pieces are joined together in attachment points 9, by welding, gluing, clamping by means of clamps, clips or the like. In this manner the above-mentioned strip having an I-shaped configuration is produced. Further strips 3, 4 are attached along their middle as seen in the transverse extension, to strips 2*b* and 2*c*, respectively, in attachment points 5*c*.

Up to this point, the biasing elements may be prefabricated. Thereafter they are put in position on the springs, whereupon the strips 3 and 2*b*, and 4 and 2*c*, respectively, are joined together at the additional attachment points 5*a* and 5*b* as illustrated in FIG. 2.

The biasing elements may be manufactured from textile materials, preferably of a kind that lends itself to welding. Other materials, such as e.g. plastics materials, non-rigid and pliable metal wire or the like, are of course also possible.

A mattress in accordance with the invention is a spring mattress of a kind comprising at least two layers exhibiting different properties of resilience but the springs of which extend across both layers, a feature which makes the manufacture and the assembly of the mattress both more convenient and less expensive than is the case with conventional mattresses.

The invention has been described herein with reference to one embodiment. Other varieties of the invention are, however, possible. For instance, other types of biasing elements are possible and the biasing elements may be used to bias only one spring at a time, the springs subsequently being joined together in the conventional manner. The biased layers could also be disposed in the middle of or at the upper part of the mattress instead of, as described herein, at the lower part thereof. In addition, the springs could have different degrees of bias along their extension, resulting in a mattress having several layers exhibiting different degrees of bias. Such varieties and modifications of the invention must be regarded as obvious and to be within the scope of protection of the invention as the latter is defined by the appended claims.

What is claimed is:

1. A spring mattress having a surface and a bottom, said mattress comprising:

at least two layers extending parallel with a plane of the mattress, said at least two layers exhibit different properties of resilience, which includes a layer with a smaller bias and a layer with a higher bias;

a plurality of interconnected coil springs, said plurality of coil springs extending across said at least two layers; and biasing elements having an I-shaped cross-section and being made from a textile material, said biasing elements being disposed at and extending between different turns of said plurality of coil springs.

2. The mattress according to claim 1, wherein said layer with said smaller bias is turned towards the surface of said mattress.

3. The mattress according to claim 1, wherein said layer with said higher bias is turned towards the bottom of said mattress.

4. The mattress according to claim 1, wherein said different turns of said coil springs to which said biasing elements are attached have a larger radial extension than the remaining turns of said coil springs, said turns extend essentially in parallel with the plane of the mattress.

5. The mattress according to claim 1, wherein said biasing elements being secured to said different turns of coil springs.

6. The mattress according to claim 1, wherein said biasing elements further comprise strip pieces, said strip pieces being disposed between said plurality of coil springs.

7. The mattress according to claim 6, wherein said strip pieces further comprises an I-shaped cross-sectional piece.

8. The mattress according to claim 6, wherein said strip pieces further comprises flat strip pieces.

9. The mattress according to claim 8, wherein said flat strip pieces have several points of attachment, wherein one point of attachment is arranged intermediate the coil springs and the other point of attachment is arranged internally of the coil springs.

10. The mattress according to claim 1, wherein at least two biasing elements are arranged in a successive relationship along a line that extends in parallel with said plane of said mattress.

11. The mattress according to claim 1, wherein at least two biasing elements are arranged in a staggered relationship along a line that extends in parallel with said plane of said mattress.

12. The mattress according to claim 1 wherein said plurality of coil springs in said layer with said smaller bias are individually resilient.

13. The mattress according to claim 1, wherein said biasing elements are made from a plastic material.

14. The mattress according to claim 1, wherein said biasing elements are made from a non-rigid and pliable metal wire.

15. A method of producing a spring mattress comprising the steps of:

providing at least two layers extending parallel with a plane of the mattress, said at least two layers exhibiting different properties of resilience;

interconnecting a plurality of coil springs, said plurality of coil springs extending across said at least two layers;

biasing said plurality of coil springs with biasing elements having an I-shaped cross-section; and disposing said biasing elements between different turns of said plurality of coil springs.

16. The method according to claim 15 wherein said step of providing at least two layers further comprises the steps of:

providing a layer with a smaller bias by turning towards a surface of the mattress; and providing a layer with a higher bias by turning towards a bottom of the mattress.

17. The method according to claim 15, further comprising the step of attaching said plurality of coil springs at a larger radial extension than the remaining turns of said coil spring.

18. The method according to claim 15, wherein said step of biasing said plurality of coil springs further comprises the step of providing strip pieces, said strip pieces being disposed between said plurality of coil springs.

19. The method according to claim 18, wherein said step of providing strip pieces further comprises the step of providing an I-shaped cross-sectional piece and flat strip pieces.

20. The method according to claim 19, wherein said step of providing flat strip pieces further comprises the step of attaching said flat strip pieces to said plurality of coil springs at several points of attachment, wherein one point of attachment is arranged intermediate the coil springs and the other point of attachment is arranged internally of the coil springs.

21. The method according to claim 15, wherein said step of biasing said plurality of coil springs further comprises the step of arranging said biasing elements into a successive relationship along a line that extends in parallel with said plane of said mattress or in a staggered relationship along a line that extends parallel with said plane of said mattress.

* * * * *